US005584754A

United States Patent [19]

Hash et al.

[11] Patent Number: 5,584,754

[45] Date of Patent: Dec. 17, 1996

[54] FLEXIBLE CONTOUR SANDING DISC

[75] Inventors: David Hash, Glen Cove; Kirk Henin, Manhasset, both of N.Y.

[73] Assignee: Sungold Abrasives USA, Inc., Port Washington, N.Y.

[21] Appl. No.: 512,454

[22] Filed: Aug. 8, 1995

[51] Int. Cl.[6] ..... B24D 11/00

[52] U.S. Cl. ..... 451/533; 451/527

[58] Field of Search ..... 451/532, 533, 451/527, 178

[56] References Cited

U.S. PATENT DOCUMENTS

| | | | |
|---|---|---|---|
| 2,755,601 | 7/1956 | Lux | 451/178 |
| 3,902,279 | 9/1975 | Lookadoo | 451/178 |
| 3,991,526 | 11/1976 | Frank et al. | 451/532 |
| 4,715,150 | 12/1987 | Takeuchi et al. | 451/527 |
| 4,945,687 | 8/1990 | Scheider et al. | 451/532 |
| 5,125,192 | 6/1992 | Welsch | 51/395 |
| 5,142,829 | 9/1992 | Germain | 51/405 |
| 5,405,286 | 4/1995 | Welsch | 451/527 |

*Primary Examiner*—Bruce M. Kisliuk
*Assistant Examiner*—Andrew Weinberg
*Attorney, Agent, or Firm*—Charles E. Temko

[57] ABSTRACT

An improved star head sanding assembly for sanding on the peripheral edges of the individual abrasive discs. The discs are provided with radially arranged non-parallel skip cuts, and are devoid of radial cutout sections to provide maximum peripheral surface area. During use, the free edges of the individual fingers tend to twist through substantially a right angle to present a line contact with the workpiece surface at least partially perpendicular to the direction of movement of the assembly relative to the workpiece.

3 Claims, 3 Drawing Sheets

FLEXIBLE CONTOUR SANDING DISC

BACKGROUND OF THE INVENTION

This invention relates generally to the field of sanding and abrading tools formed by assembling a group of sanding discs together in aligned stacked arrangement to be held together by a centrally disposed mandrel, such tools being commonly referred to in the art as "star heads". These devices are used by engaging the mandrel with a power tool and, when rotating, are applied peripherally to the surface to the sanded so that all of the discs wear at substantially the same speed.

In prior art constructions, it is usual to provide a plurality of rectilinear strips of abrasive coated sheet material, the strips being skip cut and having a centrally disposed opening. The strips are assembled on a mandrel in such manner as to provide a substantially continuous peripheral surface, although the ends of only a few of the strips are in contact with the work surface at any given instant.

U.S. Pat. No. 5,125,192 granted Jun. 30, 1992 to Welsch, discloses an improvement in this type of device characterized in the substitution of the above-mentioned strips by a sheet of abrasive material which is die cut to provide a plurality of radially extending projections joined at a centrally disposed hub supported by the mandrel. This construction has the advantage of placing considerably more abrasive in a common plane to contact the work surface, and as might be expected, the efficiency of sanding is substantially increased. However, because of the triangularly shaped open spaces between the projections, substantial gaps in the amount of abrasive material available occur when the device is in use, and the arcuately shaped end edges of the parallel fingers formed in the projections are disposed such that a major portion of each edge is substantially parallel to the direction of rotational movement, thereby limiting the abrasive effect of each finger.

SUMMARY OF THE INVENTION

Briefly stated, the invention contemplates the provision of an improved star head in which the individual discs forming the head are of complete circular configuration to present a maximum edge surface to the work. The discs are skip cut in a radial direction from the axis of the mandrel rather than parallel to form adjacent fingers which are of inwardly tapered configuration. The end edges of the fingers are thus substantially longer in a transverse direction, and more easily flexed to present edges to the work in the form of line contact transverse to the direction of movement, thus effecting greater abrasive efficiency.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
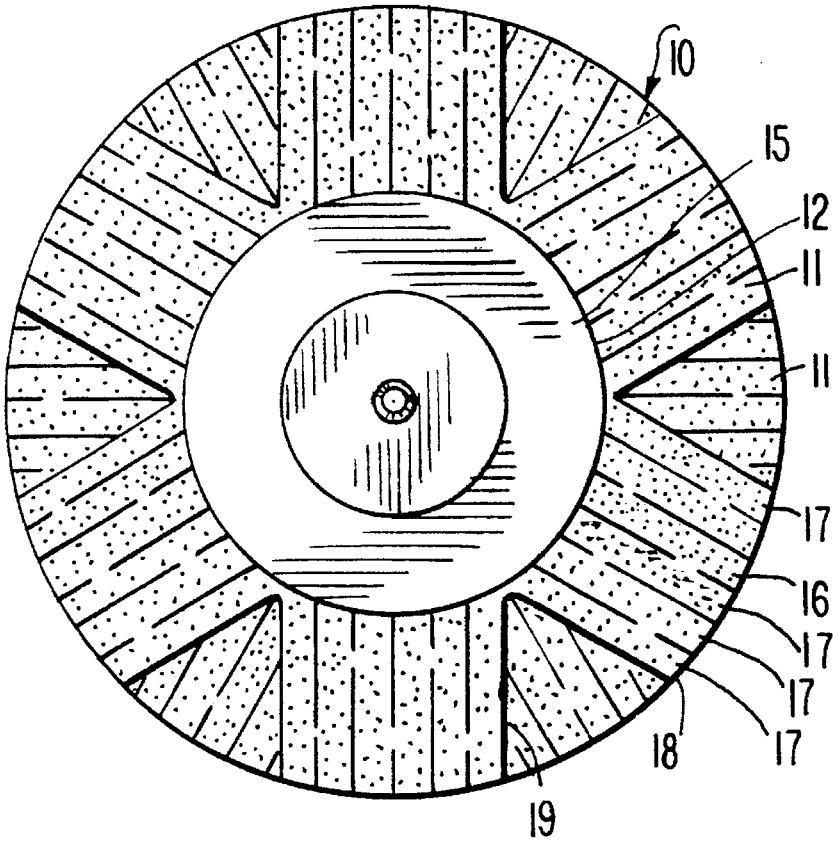
FIG. 1 PRIOR ART
FIG. 1 is a plan view of a star head in accordance with the prior art.

Before entering into a consideration of the disclosed embodiment, a brief review of the prior art is considered apposite. Referring to FIG. 1, reference character 10 designates a prior art star head disclosed in the above-mentioned patent. The head includes a plurality of superimposed discs 11 each including a centrally disposed hub 12 having an opening (not shown) to accommodate a mandrel 14 in conjunction with a supporting grommet 15. Each disc includes six radially extending projections 16, each projection forming four skip cut fingers 17 terminating in arcuate end edges 18. The fingers are mutually parallel, as a result of which the end edges 13 are of unequal length. As seen in FIG. 1, the discs are staggered so that the pie-shaped openings 19 positioned between the projections 16 are covered.

Figure 2:
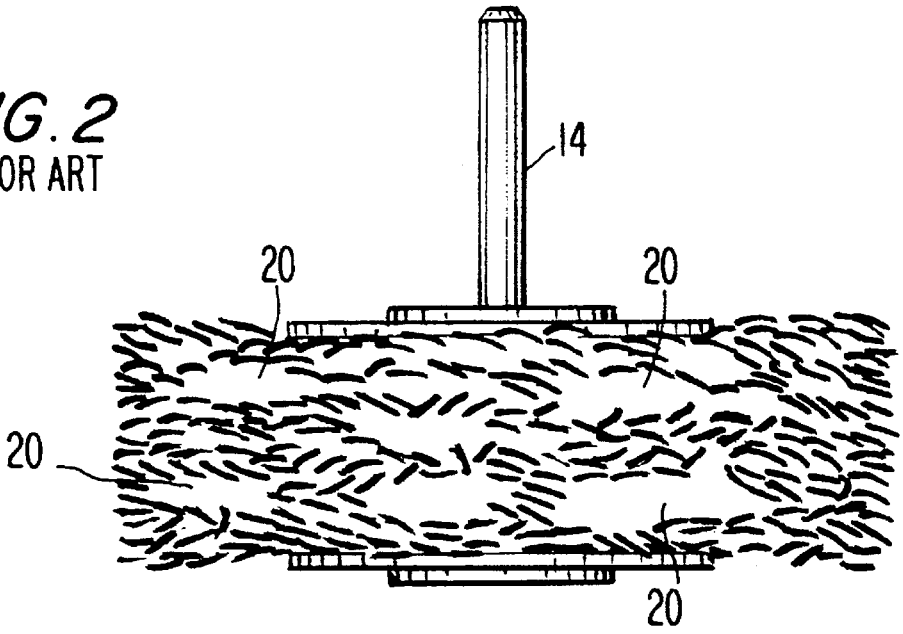
FIG. 2 PRIOR ART
FIG. 2 is a side elevational view thereof showing the edge surfaces forming the periphery of the star head after a degree of use.

Referring to FIG. 2, there is illustrated a side elevational view of the star head showing the orientation of the free outer end edges of each of the fingers comprising the projections after use. Because of the pie-shaped openings in each of the discs, there are corresponding voids 20 between adjacent discs representing the absence of fingers in those areas. The result is that the discontinuous peripheral surfaces presented to the workpiece have many elongated gaps parallel to the path of movement of the star head over the workpiece which represent the absence of abrasive and the corresponding sanding action. Although the surface of the workpiece is, in fact, covered completely during the sanding operation, the sanding efficiency is considerably less than would be the case if these gaps were not present. Further, the free edges of the fingers which are presented to the workpiece, at least upon initial contact, tend to be aligned with the direction of movement rather than transverse to it, this alignment tending to be only partially altered as the edge contacts the work surface.

Figure 3:
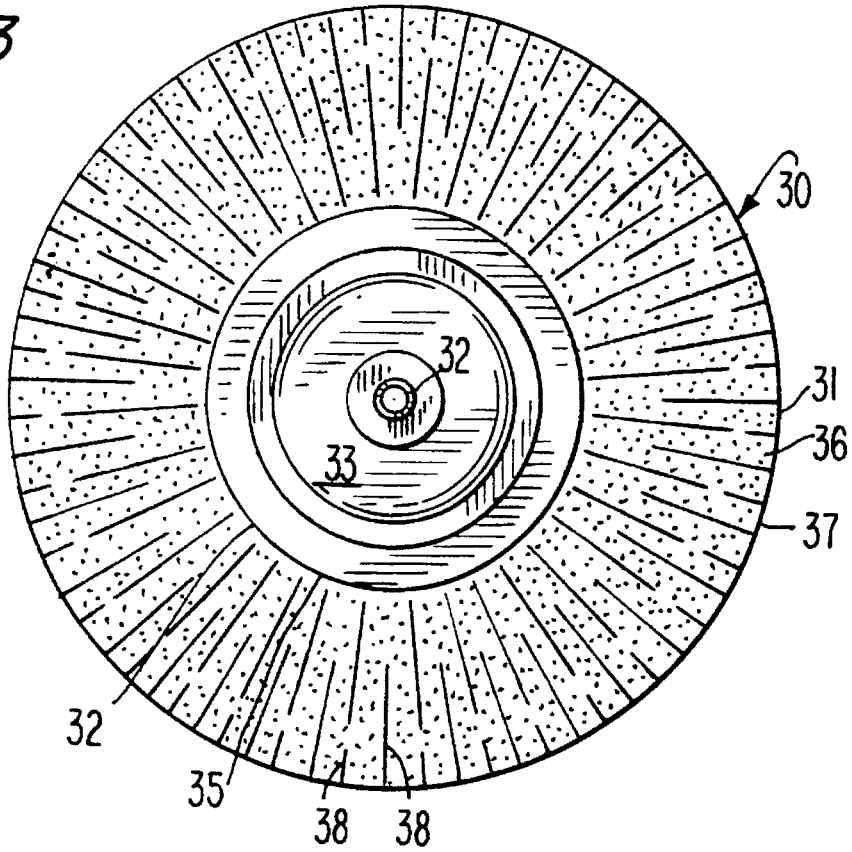
FIG. 3 is a plan view of a star head embodying the present invention.

Referring to FIG. 3, there is illustrated a star head incorporating the invention. The device, generally indicated by reference character 30, includes a plurality of completely circular discs 31, each including a centrally disposed hub (not shown) having an opening for a mandrel 32 and accompanying grommet 33. Radially outwardly from the hub is a locus of points forming a circle 35 which determines the inner ends of the flexible skip cut fingers 36. The fingers extend outwardly to a continuous outer edge 37. It will be noted that the skip cuts 38 are of two types, one of which commences at the outer edge and extends radially inward approximately two-thirds the distance to the end thereof, the other including two segments, the outermost of which extends to the peripheral edge. There are thus formed pairs of partially interconnected fingers which impart a degree of rigidity to the fingers, but allow the free end edges considerable movement relative to the end edges of the adjacent fingers.

Figure 4:
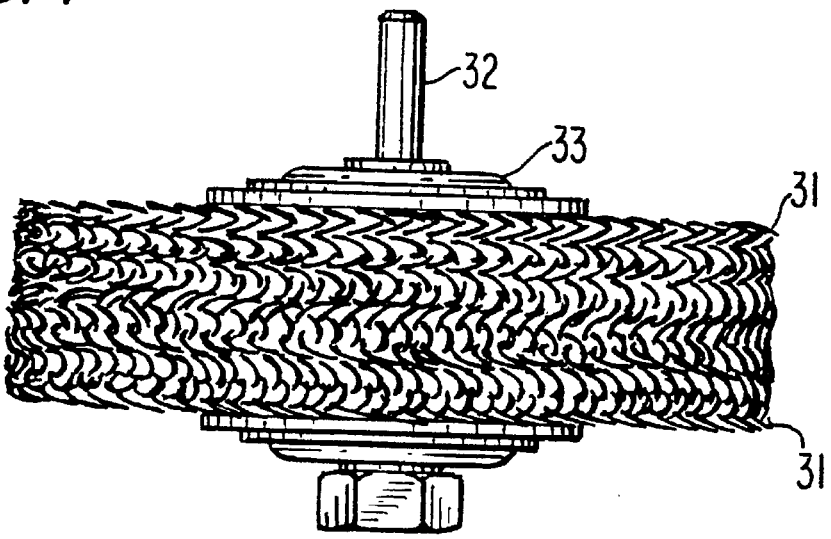
FIG. 4 is a side elevational view thereof, showing the edge surfaces forming the periphery after a degree of use.
Figure 5:
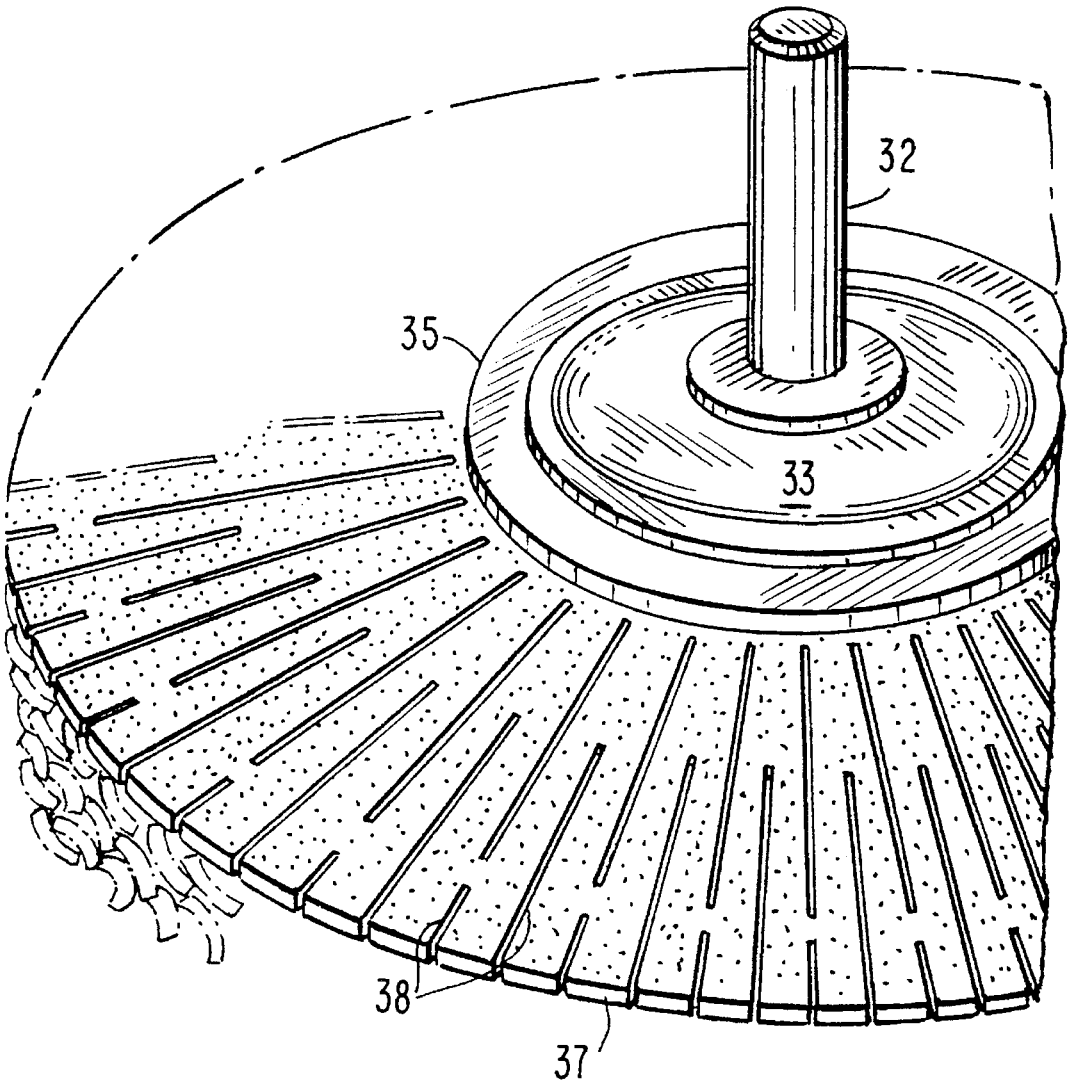
FIG. 5 is a fragmentary perspective view of the disclosed embodiment.

Referring to FIG. 4, the result of this configuration may be readily appreciated. The free end edges, after application to a workpiece, tend to twist through an arc of up to 90 degrees so as to present line contact with the working surface to be sanded which is perpendicular, rather than parallel, to the path of movement of the device. This makes for a much more even sanding operation, and greater utilization of the abrasive located at the peripheral edge. It is to be noted that there are substantially no gaps or voids between the fingers of adjacent discs, since each disc extends over a full 360 degrees, without interruption.

While the number of fingers present is a matter of choice, we have found that 33 fingers each extending over 10.9 degrees are suitable for a disc of approximately four inch diameter using normal sheet abrasive materials.

The comparative effectiveness of the inventive construction compared to the prior art construction illustrated in FIGS. 1 and 2 has been tested. In each case, a three-quarter horse power electric motor was used to spin the heads. The free spinning current in each case was 6 amperes, and the free spinning speed was 3200 R.P.M. A four inch square block of wood was pushed one inch into the path of the star head. Different parts of the same block were used for the test. In the prior art construction, the dynamic current increased to 6.2 amperes, and the speed was lowered to 3150 R.P.M. for a period of three minutes, and then went to the full speed of 3200 R.P.M. for the duration of a seven minute test. By comparison, the disclosed embodiment increased current flow to 7.2 amperes, and the speed during sanding lowered to 2197 R.P.M. for a period of five minutes, and then returned to a full speed of 3200 R.P.M. for the duration of the seven minute test.

After sanding, the peripheral patterns of the discs resembled that shown in FIGS. 2 and 4. At the end of the comparative test, there was a substantial difference in the amount of wood removed, with the disclosed embodiment removing substantially more material.

I wish it to be understood that I do not consider the invention to be limited to the precise details of structure shown and set forth in the specification, for obvious modifications will occur to those skilled in the art to which the invention pertains.

I claim:

1. In a flexible contour sanding head adapted to be driven by a rotary power source including a mandrel supporting a plurality of juxtaposed discs of flexible abrasive material, each of said discs having a central hub portion having a mounting area surrounding said mandrel, the improvement comprising: said discs being of circular configuration and having radially arranged skip cuts commencing at a circular locus of points concentric with said hub portion and extending to a peripheral edge of said disc; said skip cuts forming flexible fingers of tapered configuration separated thereby, each of said skip cuts including a segment terminating at an outer end thereof at said peripheral edge; whereby the outer edge of each finger is capable of a limited twisting motion independent of adjacent fingers upon contact with a work surface, following which at least some of said outer edges of said fingers are twisted in the order of 90 degrees to cause line contact with said work surface along an axis perpendicular to the path of relative movement therebetween.

2. A sanding head in accordance with claim 1 wherein said fingers extend over an arc of approximately 11 degrees.

3. An improved sanding disc comprising a single thickness of abrasive coated flexible planar material, said disc being bounded by an arcuate peripheral edge, and having skip cuts extending radially inwardly from said peripheral edge to form adjacent tapered fingers capable of a degree of twisting movement relative to immediately adjacent fingers, said fingers collectively covering a full 360 degrees at said peripheral edge.

* * * * *